US005265578A

United States Patent [19]

Zabeck et al.

[11] Patent Number: 5,265,578

[45] Date of Patent: Nov. 30, 1993

[54] DEVICE FOR QUANTITATIVELY REGULATING THE SUPPLYING OF BURNED GASES INTO THE COMBUSTION CHAMBER OF AN INTERNAL COMBUSTION ENGINE

[75] Inventors: Sebastian Zabeck, Hemsbach; Andreas Sausner, Frankfurt am Main, both of Fed. Rep. of Germany

[73] Assignee: Firma Carl Freudenberg, Weinheim/Bergstr., Fed. Rep. of Germany

[21] Appl. No.: 861,922

[22] Filed: Apr. 1, 1992

[30] Foreign Application Priority Data

Apr. 8, 1991 [DE] Fed. Rep. of Germany ..... 4111240

[51] Int. Cl.[5] ..... F02M 25/07

[52] U.S. Cl. ..... 123/568

[58] Field of Search ..... 123/568, 569, 570

[56] References Cited

U.S. PATENT DOCUMENTS

| | | | |
|---|---|---|---|
| 3,610,219 | 10/1971 | Sciabica | 123/568 |
| 3,675,633 | 7/1972 | Nakajima et al. | 123/568 |
| 3,882,837 | 5/1975 | Horie et al. | 123/568 |
| 3,954,091 | 5/1976 | Stumpp | 123/568 |
| 4,233,946 | 11/1980 | Yorioka et al. | 123/568 |
| 5,056,309 | 10/1991 | Linder et al. | 123/568 X |

*Primary Examiner*—Willis R. Wolfe

*Attorney, Agent, or Firm*—Kenyon & Kenyon

[57] ABSTRACT

A device for feeding burned gases in measured quantities into the combustion chamber of an internal combustion engine. A throttle valve is configured in the suction pipe. The exhaust pipe is coupled to the exhaust pipe by a line comprising a shutoff valve. The throttle valve is mounted on a drive shaft in the suction pipe. The shutoff valve comprises a closing element, which is able to be actuated by the drive shaft.

13 Claims, 1 Drawing Sheet

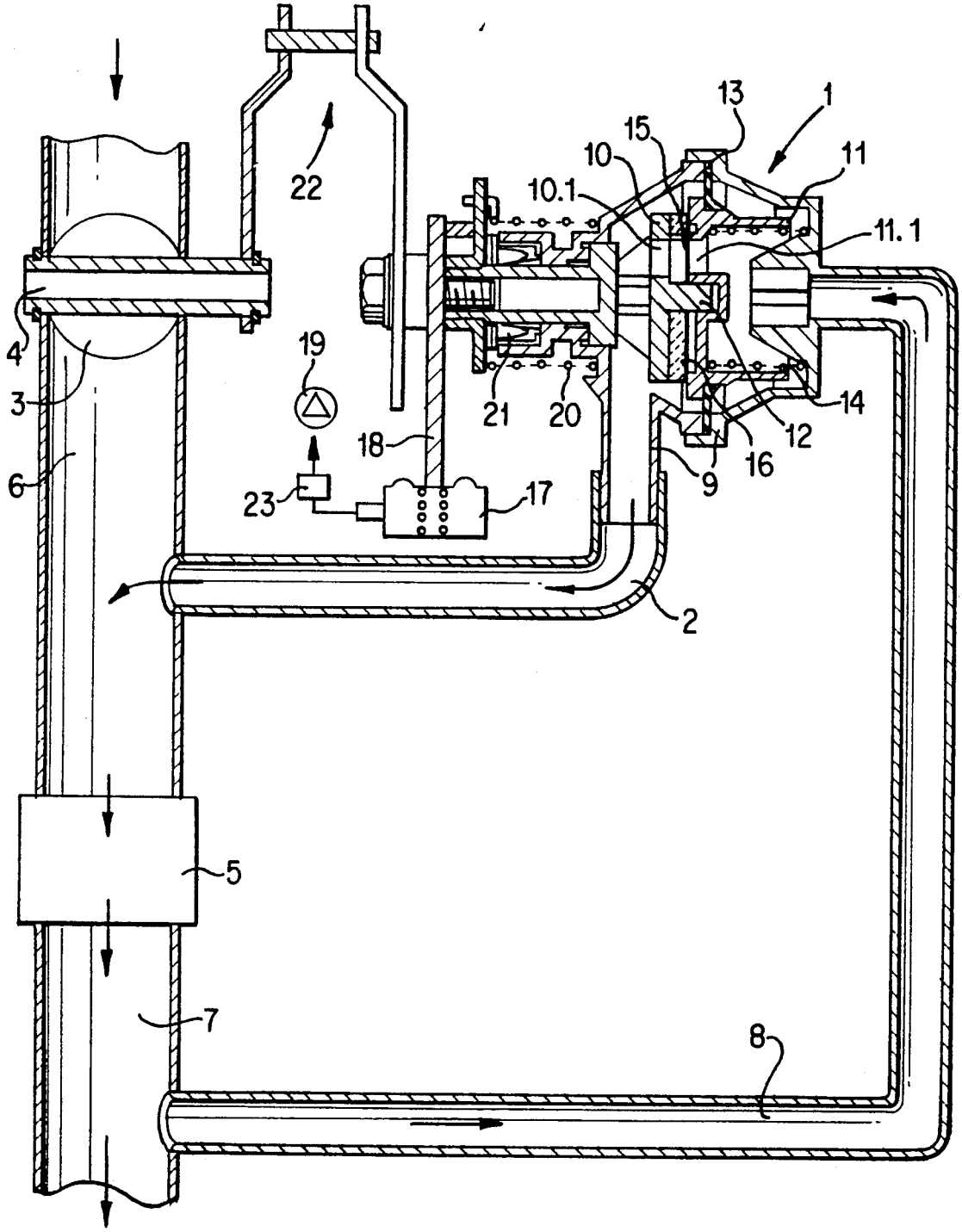
1
2
3
4
5
6
7
8
9
10
10.1
11
11.1
12
13
14
15
16
17
18
19
20
21
22
23

DEVICE FOR QUANTITATIVELY REGULATING THE SUPPLYING OF BURNED GASES INTO THE COMBUSTION CHAMBER OF AN INTERNAL COMBUSTION ENGINE

BACKGROUND OF THE INVENTION

The present invention relates to a device for supplying burned gases in measured quantities into the combustion chamber of an internal combustion engine having a throttle valve configured in a suction pipe and an exhaust pipe. More particularly, the present invention relates to such a device where the suction pipe and the exhaust pipe are connected by a line containing a shutoff valve and where the throttle valve is mounted on a drive shaft in the suction pipe.

A known device is described in the Bosch manual, *Automotive Electricity, Automotive Electronics in the Otto Engine.* The throttle valve and the shutoff valve are provided with driving mechanisms which work independently of one another. As a result, this device is extremely expensive to manufacture. In addition, the device is characterized by an unsatisfactory operational reliability and functionality.

An object of the present invention is to considerably improve the operational reliability and functionality of such a device, as well as the capability of manufacturing such a device in a more cost-effective manner.

SUMMARY OF THE INVENTION

This and other objectives are met by the device of the present invention. In the device, the shutoff valve comprises an actuator, which is capable of being operated by a drive shaft. Such a configuration enables the device to be manufactured and assembled cost-effectively. Also, the device has excellent working properties over a long service life and achieves a clear reduction in environmentally harmful exhaust-gas emissions by dispensing with the supplemental use of electronic control elements. Due to the ability to produce the device economically and its compact size, the device is particularly suited for equipping internal combustion engines in small, economy class motor vehicles.

A closing element and the drive shaft can be interconnected by a connecting device, which is made up of a one-sided restraint. In case of disturbances in the movement of the closing element, the throttle-valve movement is effectively prevented from being obstructed with only a one-sided restraint of the closing element by the drive shaft of the throttle valve. The throttle valve can be reset at any time as a result of a rotation of the throttle-valve shaft, so that the operational reliability of the connected internal combustion engine and of the motor vehicle is not adversely affected.

In another embodiment of the present invention, the valve is designed as a rotary-slide valve, with a valve housing and two adjusting disks. The adjusting disks are supported in the valve housing and touch on one another with relative rotating capability. The adjusting disks are disposed outside of their torsional axis with at least one opening which can be covered. The first adjusting disk can rotate by means of the drive shaft, and the second adjusting disk is locked to prevent turning in the valve housing. Because the shutoff valve is subjected to a comparatively high thermal stress, the materials used for the device must be selected accordingly. Thus, a gray cast-iron alloy is a suitable material for the valve housing, and a metallic or ceramic material is a suitable material for the two adjusting disks. In a further embodiment of the invention, the valve has a particularly small type of construction, comprising only a few component parts, making it simple to drive the rotary slide valve by means of the drive shaft (on which the throttle valve is also supported). Temperature-resistant seals are provided to seal off the drive shaft. Also, the size of the opening can be very finely adjusted to the current operating state of the internal combustion engine. Because of the small design and the use of only a few component parts, a device is obtained which weighs less and entails lower manufacturing costs.

The second adjusting disk can be movably supported in the direction of the torsional axis, secured with respect to the valve housing to prevent turning, and sealed by a membrane. The material used for the membrane is also heat-resistant due to the high exhaust-gas temperatures. The rotatable bearing arrangement of the first adjusting disk relative to the second adjusting disk, which is rotatably fixed in the housing, guarantees over a long service life, that the two adjusting disks are properly guided. Less wear or abrasion on one of the two adjusting disks does not adversely affect the seal in this area because the second adjusting disk is braced by a compression spring in the valve housing and pressed against the first adjusting disk. To provide a good sealing action inside the valve between the suction chamber and the exhaust chamber, a membrane is inserted between the two valve-housing parts and is affixed to the second adjusting disk so that it is impermeable to gas. If the openings of the two adjusting disks are closed, no exhaust gas arrives in the suction pipe of the internal combustion engine. When the compression spring is designed as a helical compression spring, its spring characteristic can be adjusted quite easily to be used with the specific characteristic values with respect to the application pressure. This produces excellent working properties for the valve over a long service life.

The two adjusting disks are rotatably supported, one inside the other. For example, this can be achieved by using a bearing journal, which is coupled in one piece to the first adjusting disk. If necessary (e.g., for example to offset manufacturing tolerances), this bearing journal can have a convex, crown-type design. The bearing journal can be supported in a bearing-journal receptacle of the second adjusting disk. In another improvement of the present invention, the bearing journal is coupled in one piece to the second adjusting disk and supported in a bearing-journal receptacle of the first adjusting disk. Also, both the first and second adjusting disks can be provided with a journal-bearing receptacle, where a separate journal bearing, which interconnects the two adjusting disks, is arranged in the axial direction, coaxially to the torsional axis. This guarantees a good torsional mobility of the two adjusting disks relative to one another. It also guarantees that the two adjusting disks are properly localized with respect to one another, outside of the openings and in a manner that is impermeable to gas.

To enable the device to be actuated easier and with more sensitivity, at least one of the two adjusting disks in the vicinity of the reciprocal contact surfaces can be provided with a temperature-resistant, friction-reducing surface coating. For example, these requirements are fulfilled by an intermediate plate having a coated surface. The intermediate plate can be made of a ceramic material, which is attached and sealed to one of the two adjusting disks so that it is relatively locked to prevent turning.

If at least one of the two adjusting disks comprises ceramic or gray cast iron, then the intermediate disk is omitted. The adjusting disks have good sliding properties and negligible wear. Also, the connecting device can comprise a closing device with a low-pressure vacuum diaphragm, which carries the first adjusting disk, as needed, in the direction of the closed position of the shutoff valve. This is done advantageously against the spring tension of a torque spring. In this manner, it is guaranteed that the device is able to close independently of the position of the throttle valve. Thus, given a cold internal combustion engine, it is possible, for example, to stop or at least infinitely reduce the return of exhaust gas into the suction pipe.

A suction pump and a vacuum shift valve can be allocated to the low-pressure vacuum diaphragm. The vacuum shift valve can be connected in a signal-conducting manner to the motor control unit. The shift valve serves to control the vacuum acting on the low-pressure vacuum diaphragm, whereby the vacuum can be produced by a suction-pipe vacuum or a suction pump. More complicated circuit arrangements also make it possible to have a suction-pressure modulation for intermediate positions between a completely open passage area and a closed passage area. One advantage is that the low-pressure vacuum diaphragm is arranged outside of the actual valve. As a result, a simple production capability continues to be guaranteed. When the device is used for internal combustion engines, which make available a sufficient vacuum in the suction pipe, the low-pressure vacuum diaphragm can be vacuum-charged by the suction pipe. In this case, it is advantageous that the device can be manufactured more economically.

BRIEF DESCRIPTION OF THE DRAWING

The sole drawing figure is a cross-sectional view of a device for feeding burned gases in measured quantities into the combustion chamber of an internal combustion engine, constructed according to the present invention.

DETAILED DESCRIPTION

Referring to the drawing figure a device is shown for feeding burned gases in measured quantities into the combustion chamber of an internal combustion engine 5. A supply line 2 is provided leading to the suction pipe 6 of the internal combustion engine 5 in the vicinity of the throttle valve 3. The supply line 2 is also coupled to the shutoff valve 1. A line 8 is provided to feed the burned gases back into the internal combustion engine 5. The line 8 is allocated on one side to the exhaust pipe 7 and is connected on the other side to the shutoff valve 1. The supply line 2 leading to the suction pipe 6 of the internal combustion engine 5 can be sealed by the shutoff valve 1 and/or, independently of the position of the shutoff valve 1, by a connecting device 22. This connecting device 22 is assigned to a low-pressure vacuum diaphragm 17, which is coupled to a suction pump 19 with an interconnected vacuum shift valve 23.

A throttle valve 3, which is supported on a drive shaft 4, is arranged in the suction pipe 6. The shutoff valve 1 comprises a rotary slide valve as an actuator, which can be actuated by the drive shaft 4 with its attached connecting device 22. The connecting device 22 is made up of a one-sided restraint. This guarantees a functional separation of the device from the movement of the throttle valve. If the throttle valve 3 is carried by the drive shaft 4 into the open position, the first adjusting disk 10 is also rotated by the connecting device to such an extent that the opening cross-section is enlarged by the shutoff valve 1. The throttle valve opens the shutoff valve against the spring tension of a torque spring 20, which also moves the rotary slide valve into a closed position again when functioning properly. If malfunctions result inside the shutoff valve 1, the throttle valve will not be arrested in the open position, which means that the operational reliability of the motor vehicle continues to be guaranteed.

The rotary slide valve comprises two adjusting disks 10, 11, which are arranged and supported in the valve housing 9 and touch on one another with relative rotating capability. Openings 10.1, 11.1 are configured in each case in the adjusting disks 10, 11. They are designed to have different sizes in dependence upon the specific application and can have varying shapes. In this embodiment, the first adjusting disk 10 is supported by the drive shaft 4 in the valve housing 9 so that it can rotate relative to the second adjusting disk 11. The first adjusting disk 10 is provided with an intermediate disk 16, which is designed as a sealing disk made of ceramic material. It is localized to prevent turning directly on the first adjusting disk 10. To improve the sliding properties, the intermediate disk 16 can be provided with a surface coating 15. The two adjusting disks 10, 11 lie against each other outside of the partially covered openings 10.1, 11.1 so that they can rotate and are impermeable to gas.

To seal the two-part housing, a membrane made of temperature-resistant material is clamped between the two housing halves and acts as a protection against torsion for the second adjusting disk ii. The second adjusting disk 11 and the membrane 13 are localized contiguously to one another, so that they are locked to prevent turning and are impermeable to gas. This produces an excellent sealing between the gas intake and gas outlet when the openings 10.1, 11.1 are closed. To improve the sealing effect in the vicinity of the two adjusting disks 10, 11, the second adjusting disk 11 is movably braced in the direction of the torsional axis 12 by a compression spring 14 on the valve housing 9 and is pressed against the first adjusting disk 10. The two adjusting disks 10, 11 are arranged so that one can rotate inside the other by a bearing journal of the first adjusting disk 10. This bearing journal is arranged axially to the torsional axis and is supported in a recess of the second adjusting disk 11. In addition to the compression spring 14, another spring is provided, which is designed as a torque spring 20 which is secured on one side in the valve housing 9 and on the other side in the connecting device 22. Furthermore, between the drive shaft 4 and the valve housing 9, a seal 21 is provided, which seals off the drive opening from the environment.

What is claimed is:

1. A device for feeding burned gases in measured quantities in a combustion clamber of an internal combustion engine, comprising:

a membrane sealing said second adjusting disk to said housing;

a suction pipe coupled to said internal combustion engine;

a throttle valve supported on a drive shaft and located within said suction pipe;

an exhaust pipe coupled to said internal combustion engine;

a rotary-slide shutoff vale including a closing element, which is capable of being actuated by said drive shaft, said shutoff valve including:

a vale housing; and first and second adjusting disks supported in said valve housing, each of said adjusting disks having a face, such that the face of said first adjusting disk abuts said second adjusting disk, each of said adjusting disks has a torsional axis and at least one opening outside said torsional axis, said first adjusting disk capable of being rotated by said drive shaft, said second adjusting disk being locked in said housing and incapable of being rotated;

a first supply line coupled between said suction pipe and said shutoff valve; and a second line coupled between said exhaust pipe and said shutoff valve, said shutoff valve capable of limiting a flow of exhaust gases from said exhaust pipe and said second line to said first supply line and said suction pipe.

2. The device of claim 1, further comprising:

a connecting device comprising a one-sided restraint coupled between said drive shaft and the closing element of said shutoff valve.

3. The device of claim 1, wherein said second adjusting disk is movably supported in a direction of said torsional axis, said second adjusting disk being incapable of turning laterally to said torsional axis, said valve further comprising:

a membrane sealing said second adjusting disk to said housing.

4. The device of claim 3, further comprising:

a connecting device comprising a one-sided restraint coupled between said drive shaft and the closing element of said shutoff valve.

5. The device of claim 3, wherein said valve further comprises:

a compression spring coupled to said second adjusting disk and said housing, said compression spring urging the face of said second adjusting disk against the face of said first adjusting disk.

6. The device of claim 5, wherein said second adjusting disk is rotatably supported on said first adjusting disk.

7. The device of claim 6, wherein at least one of said first and second adjusting disks includes a surface coating to reduce friction between corresponding faces of said adjusting disks.

8. The device of claim 7, wherein at least one of said first and second adjusting disks is made of a ceramic.

9. The device of claim 7, wherein at least one of said first and second adjusting disks is made of a gray cast iron.

10. The device of claim 9, wherein said valve further comprises:

an intermediate disk coupled between said first and second adjusting disks, said intermediate disk being sealingly coupled to one of said first and second adjusting disks such that said intermediate disk is prevented from rotating around said torsional axis relative to said one of said adjusting disks.

11. The device of claim 10, wherein said connection device comprises:

a connecting device with a low-pressure vacuum diaphragm, selectably carrying said first adjusting disk to a closed position in said shutoff valve.

12. The device of claim 11, further comprising:

a suction pump coupled to said low-pressure vacuum diaphragm; and a vacuum shift valve coupled between said low-pressure vacuum diaphragm and said suction pump.

13. The device of claim 12, Further comprising:

an electromagnetic shift valve coupled to said low-pressure vacuum diaphragm, such that said electromagnetic shift valve is capable of actuating said low-pressure vacuum diaphragm; and a motor control unit coupled in a signal-conducting manner to said electromagnetic shift valve.

* * * * *